US005617679A

United States Patent [19]

Meyers

[11] Patent Number: 5,617,679

[45] Date of Patent: Apr. 8, 1997

[54] STACKABLE RISER FOR ON-SITE WASTE AND DRAINAGE SYSTEMS

[75] Inventor: Theodore W. Meyers, Inverness, Ill.

[73] Assignee: Tuf-Tite, Inc., Wauconda, Ill.

[21] Appl. No.: 365,706

[22] Filed: Dec. 29, 1994

[51] Int. Cl.[6] ..... E02D 29/14

[52] U.S. Cl. ..... 52/20; 52/79.1; 52/136; 220/4.26; 405/136; 405/41

[58] Field of Search ..... 52/79.1, 79.7, 52/20, 169.6, 19, 134, 136, 137, 142, 139; 404/25, 26; 174/37, 39; 405/41, 43, 80, 83, 136, 137, 161; 220/4.26, 4.03

[56] References Cited

U.S. PATENT DOCUMENTS

| | | | |
|---|---|---|---|
| 3,772,826 | 11/1973 | Ferver | 52/137 X |
| 4,472,911 | 9/1984 | Jooris et al. | 52/20 |
| 4,663,036 | 5/1987 | Stobl, Jr. et al. | 210/170 |
| 4,998,387 | 3/1991 | Geiger | 52/20 |
| 5,046,886 | 9/1991 | Muir et al. | 52/20 X |

FOREIGN PATENT DOCUMENTS

| | | | |
|---|---|---|---|
| 1964319 | 12/1969 | Germany | 52/19 |
| 2185053 | 7/1987 | United Kingdom | 52/20 |

*Primary Examiner*—Carl D. Friedman
*Assistant Examiner*—W. Glenn Edwards
*Attorney, Agent, or Firm*—Tilton, Fallon, Lungmus & Chestnut

[57] ABSTRACT

A plastic stackable riser for providing a grade level access for underground components such as septic tanks, distribution boxes, and drop boxes, is disclosed. The stackable riser includes a continuous peripheral side wall having a top free edge and a bottom edge. The top free edge defines a first end opening and the second bottom edge is connected to a generally inverted U-shaped connecting member which defines a channel shaped to receive the first free edge portion of an adjacent stackable riser. In use, a plurality of stackable risers are interlocked together so that the side walls all extend along common vertical axes to the underground component.

31 Claims, 7 Drawing Sheets

STACKABLE RISER FOR ON-SITE WASTE AND DRAINAGE SYSTEMS

BACKGROUND AND SUMMARY

Conventional drainage and septic systems typically include underground components which require periodic access for cleaning or servicing. Most notably, septic tanks are typically pumped out every few years or even, in some cases, annually or more frequently. Other components of septic systems such as distribution boxes also often require periodic servicing. In order to gain access to such underground components, workers commonly use metal rods or the like to first locate the component and then they must remove the dirt above the component which is labor-intensive. Often, workers must remove dirt over a fairly wide area to correctly locate the lid of the component, or an access opening in the lid. Obviously, the conventional methods of locating and gaining access to underground drainage and septic components is time consuming and expensive. In addition, there has been a general trend by states and municipalities to require grade level access to underground components, so as to prevent such components from becoming "lost" which frequently occurs.

Attempts have been made to remedy the above problems by providing grade level access and a passageway between grade level and the underground component. Such attempts have often been make-shift assemblies roughly put together in the field. In one known example, clay tile or cement chimney flues have been positioned over a septic tank to provide a passageway between the septic tank and grade level. Such attempts have been less than successful in that ceramic chimney flues often have predetermined lengths of a foot or more, and such components are not easily length-adjustable, i.e. cutting a flue component is time-consuming, expensive and requires specialized tools. Chimney flues are also expensive, and such tile or cement components are also heavy and difficult to handle which leads to labor-intensive and expensive installation.

Another known prior art attempt at creating a crude riser was advertised for sale by American Manufacturing Company, Inc., Manassas, Va., in an October 1989 catalog. That construction was specifically aimed at providing a riser for use with septic system distribution boxes. The so-called "riser" was actually another distribution box unit in which, after first cutting out its bottom, that modified narrow bottom was simply fitted into an opening formed in the wider top of the actual distribution box, so as to create a make-shift riser having a height of about 14 inches. In effect, the user had to cut out the bottom and top of an expensive distribution box to form a riser. Such a construction had many shortcomings including the time-consuming installation process of cutting the top and bottom out of the distribution box to form a riser. For example, distribution boxes are relatively expensive components, and also, their rather flimsy thin-walled construction is unsuitable for holding up under the high weight-bearing loads normally applied to a riser structure at grade level, i.e. garden tractors and even pick-up trucks. The American manufactured type distribution box riser also has a predetermined height of about 14 inches, which excessive height is impractical to adjust from a standpoint of difficulty in cutting the device, plus the fact that a cut edge in a drop box does not readily accept a preformed lid or grade level access cover. A significant shortcoming of this particular prior art riser construction is that the American manufactured distribution box has angled side walls, which walls inefficiently distribute the weight placed on the top riser to the bottom distribution box, often resulting in breakage. This weight-bearing load capacity factor is an important consideration when it is considered that, at best, people and 1000 pound riding mowers will pass over the grade level access lid and, at worse, heavier vehicles such as pickup trucks may drive over the lid.

An important aspect of the present invention therefore lies in providing a unique stackable riser formed of light-weight plastic which is usable to form a height-adjustable grade level access for underground components and which forms a rigid structure capable of supporting heavy loads applied to the grade level access lid. A suitable cover means such as an imperforate cover or a drain grate is used to seal the uppermost stackable riser in the vertical riser tower. The injection-molded plastic stackable risers are lightweight and easy to handle. A plurality of such risers can be used to easily, simply and efficiently form a vertical passageway and grade level access above an underground drainage or waste system component.

In brief, the stackable riser of this invention includes a continuous peripheral side wall having outer and inner surfaces and having a first free edge portion and a second edge portion. The side wall of the riser extends in a substantially perpendicular direction with respect to a horizontal plane. The first free edge portion defines a first end opening, and the second edge portion is provided with a U-shaped connecting member which forms an oppositely-facing second end opening. The U-shaped connecting member includes a transverse intermediate portion and first and second generally perpendicular dependent legs which define a channel which is shaped to receive a first free edge portion of another riser. The riser is stackable with other risers to form a riser combination in which the first free edge portions of the risers are interconnected with the U-shaped connecting members of the adjacent risers.

The inner and outer surfaces of the side wall are preferably provided with vertically-extending ribs for strengthening the side wall. However, the inner ribs further include terminal edges which form shoulders positioned a predetermined distance away from the tip of the first free edge portion of the side wall. These shoulders form a ledge for receiving the first dependent leg of the U-shaped connecting member of an adjacent riser so that the first dependent legs and inner ribs of a riser stack all extend along a common vertical axis for efficiently transmitting weight-bearing loads through the entire riser stack. Each of the risers is also preferably provided with a horizontally-extending rib for reinforcing the riser unit's side wall. A horizontally-extending rib preferably extends outward from the intermediate portion of the U-shaped connecting member.

In one embodiment, the peripheral side wall of the riser includes four sidewall sections which form a generally square or rectangular-shaped riser having four internal corners on the inner surface of the side wall. Each of the corners is provided with a vertically-extending attachment member which includes a shoulder positioned to receive a screw for facilitating attachment of cover means to the riser. In order to allow for selective vertical height adjustment between the underground component and grade level, the side wall of each riser preferably has a vertical height of approximately 3 to 7.5 inches, and preferably 6 inches, so that no cutting of the risers is required.

When a plurality of stackable risers of this invention are stacked together, the side walls of each riser are stacked directly on top of each other and extend along a first common vertical axis for efficiently transmitting weight-bearing loads through the vertical stack. In addition, the first dependent leg of the U-shaped attachment member and the inner ribs also extend along a second common vertical axis for efficiently transmitting loads through the stack. The stackable riser of this invention in usable in combination with underground components such as septic tanks, distribution boxes, or drop boxes.

In the combination of the stackable riser and a distribution box, the distribution box includes angled side walls, a transverse peripheral shoulder extending from a top of the side walls, and a vertically-extending flange. The flange is shaped to be received within the channel formed by the U-shaped connecting member of the risers. When the risers are connected to the distribution box, the side wall of the first riser is positioned directly above the flange of the distribution box. In use, the transverse shoulder of the distribution box extends outward over backfill so that weight-bearing loads which act upon the vertical stack of risers is transmitted directly through the side walls of the risers and the flange of the distribution box to the backfill, thereby transferring the load away from the angled side walls of the distribution box which might otherwise undesirably result in breakage.

Cover means are provided for attachment to the uppermost riser of the riser stack and covering the vertical passageway formed by same. The cover means may take the form of an imperforate cover or a drain grate, which might be desirable in some applications. The imperforate cover of this invention includes a peripheral U-shaped attachment portion which includes a transverse intermediate portion and first and second depending legs and which defines a channel shaped to receive the top free edge of a riser. A dome-shaped cover plate portion connects to the transverse intermediate portion of the U-shaped attachment portion. The U-shaped attachment portion of the cover may be substantially similar to, or the same as, the U-shaped connecting portion of the stackable risers of this invention.

The imperforate cover is preferably provided with a centrally located circular rib on an inner surface of the dome-shaped plate portion and a plurality of radially-spaced ribs extend between the circular rib portion and the first depending leg of the U-shaped connection portion. Such an arrangement of ribs effectively forms a strong weight-bearing cover which efficiently transfers any weight-bearing loads through the side walls of the risers in the vertical stack and directly to the septic tank, distribution box or other underground component.

Other features, objects and advantages of the invention will become apparent from the following drawings and description.

DESCRIPTION OF PREFERRED EMBODIMENTS

Figure 1:
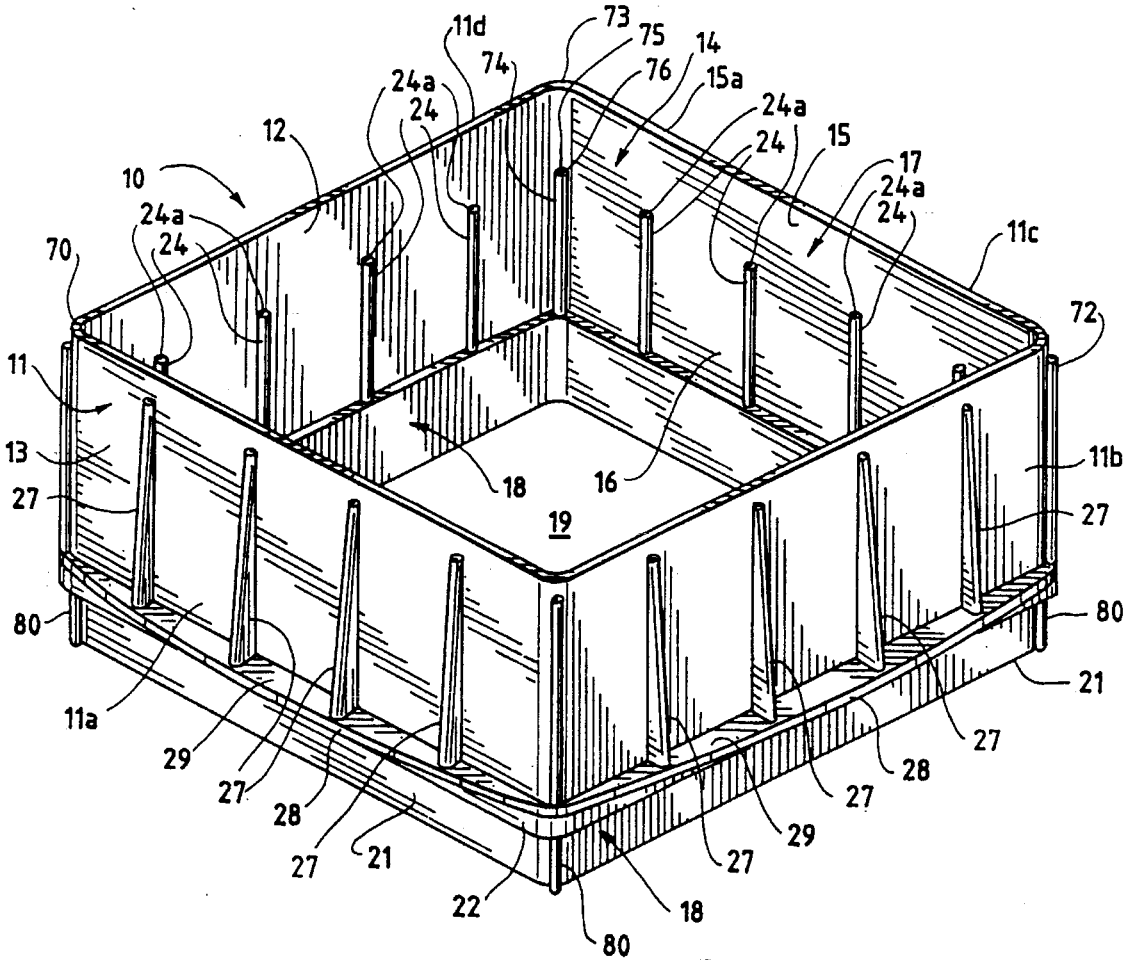
FIG. 1 is a perspective view of the stackable riser embodying this invention.

Referring to the drawings, the numeral 10 generally designates the stackable riser of this invention which includes a continuous peripheral side wall 11 having inner and outer surfaces 12 and 13, respectively. In the given illustrations, side wall 11 includes four sidewall sections 11*a*, 11*b*, 11*c* and 11*d* which define a passageway 14 having a generally square shape. However, it will be understood that peripheral side wall 11 may form differently shaped passageways, such as rectangular, triangular or circular depending upon the particular application of the riser.

Figure 4:
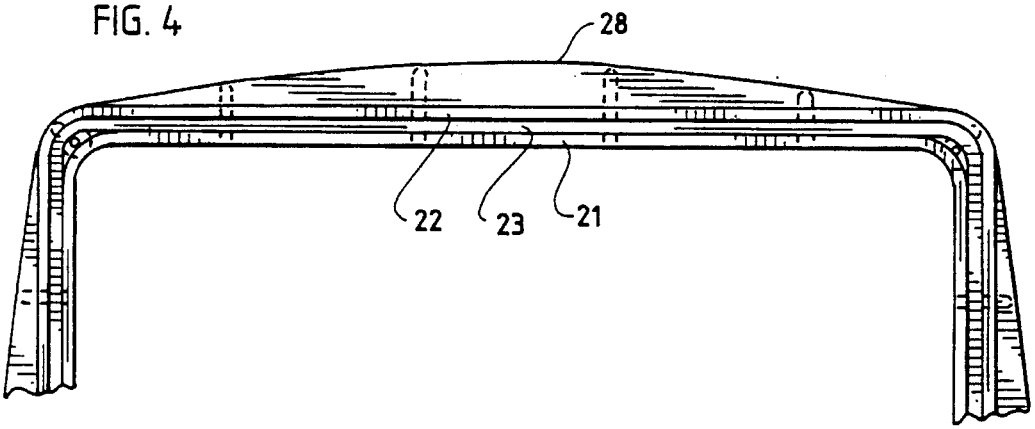
FIG. 4 is a partial bottom plan view of the stackable riser of this invention.
Figure 5:
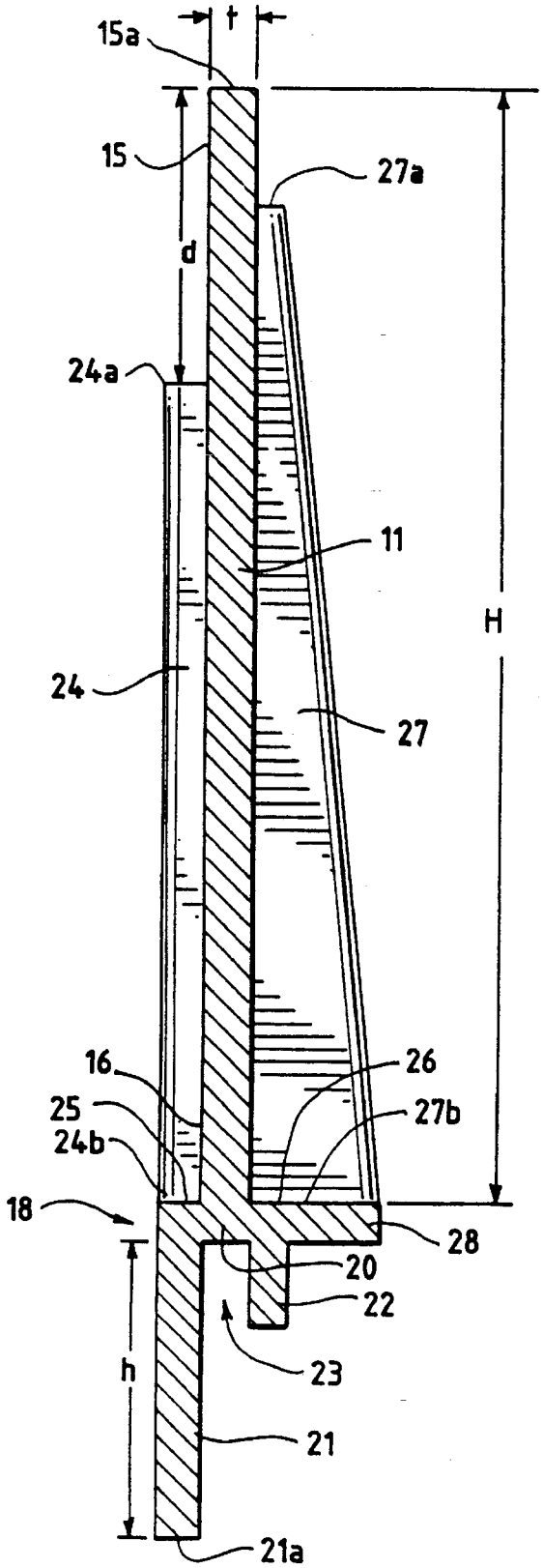
FIG. 5 is a cross-sectional view taken along line 5—5 of FIG. 4.

Side wall 11 includes a first free edge portion 15 and a second edge portion 16, the first free edge portion 15 defining a first end opening 17. A generally inverted U-shaped connecting member 18 extends from bottom edge portion 16 of side wall 11 and defines an oppositely-facing second end opening 19. As most clearly illustrated in FIG. 5, generally U-shaped connecting member 18 includes a transverse intermediate portion 20 and first and second dependent legs 21 and 22, respectively. Connecting member 18 defines a channel 23 which is shaped to receive the free edge portion 15 of side wall 11 of another riser. As shown in FIG. 4, first dependent leg 21 has a smaller perimeter than side wall 11 and dependent leg 22 has a greater perimeter than side wall 11 so that channel 23 is positioned directly below side wall 11 as seen in FIG. 5.

The inner surface 12 of side wall 11 is preferably provided with a plurality of vertically-extending inner ribs 24. Inner ribs 24 include terminal ends which form shoulders 24*a* spaced a predetermined distance d away from a tip 15*a* of edge portion 15. Predetermined distance d has approximately the same length as a vertical height h of dependent leg 21 so that, when a plurality of risers are stacked together, the distal edge 21*a* of leg 21 rests upon shoulders 24*a* of ribs 24. Transverse intermediate portion 20 includes inner and outer shoulders 25 and 26, respectively, and the opposite edges 24*b* of ribs 24 are positioned on the inner shoulder 25 of transverse portion 20.

A plurality of vertically-extending outer ribs 27 are preferably provided on outer surface 13 of peripheral side wall 11 to strengthen the side wall. In the given illustrations, outer ribs 27 include terminal ends 27*a* which terminate shortly before the tip 15*a* of edge portion 15 and opposite edges 27*b* which rests on the outer shoulder 26 of transverse portion 20 of connecting member 18.

A horizontally-extending rib 28 is also preferably provided around the perimeter of side wall 11 to provide rigidity to wall sections 11*a*–11*d* and to maintain the peripheral shape formed by the side wall. In the given illustrations, horizontal rib 28 extends transversely outward from the intermediate portion 20 of connecting member 18. However it will be understood that the horizontal rib may be provided on other portions of the side wall for reinforcement. Advantageously, horizontal rib 28 includes a ledge 29 which facilitates installation by providing a gripping portion and, also, when the device is installed in underground applications, the backfill will rest upon ledge 29 to hold the riser in position.

One or more of risers 10 are useful to form, in ready snap together fashion, a vertical tower or passageway between a grade level access and an underground component such as a septic tank or distribution box. Since providing a riser which requires any type cutting is considered impractical, inconvenient, and labor-intensive, and labor-intensive, side wall 11 of riser 10 preferably has a vertical height H of approximately 2 to 7.5 inches, and preferably about 6 inches. Each of the side wall sections 11*a*–11*d* preferably have a length L of about 8 to 22 inches, preferably about 16 inches, to form a sufficient opening to allow access to an underground component but generally not wide enough to allow entry of adult humans. In one example construction, side wall sections 11*a*–11*d* have a length L of about 16 inches and side wall 11 has a vertical height of about 6 inches. However, as mentioned, it will be understood that other desired shapes may be formed by side wall 11. Side wall 11 preferably has a thickness t of approximately 0.15 to 0.2 inches.

Stackable riser 11 is preferably formed from high density polyethylene and may be injection molded in a conventional manner. It will also be understood that other lightweight rigid polymeric materials such as polypropylene may be suitable. Forming stackable riser 11 of such a lightweight plastic is highly advantageous as the construction is lightweight, easy to handle and install, and of non-corrosive material.

Figure 6:
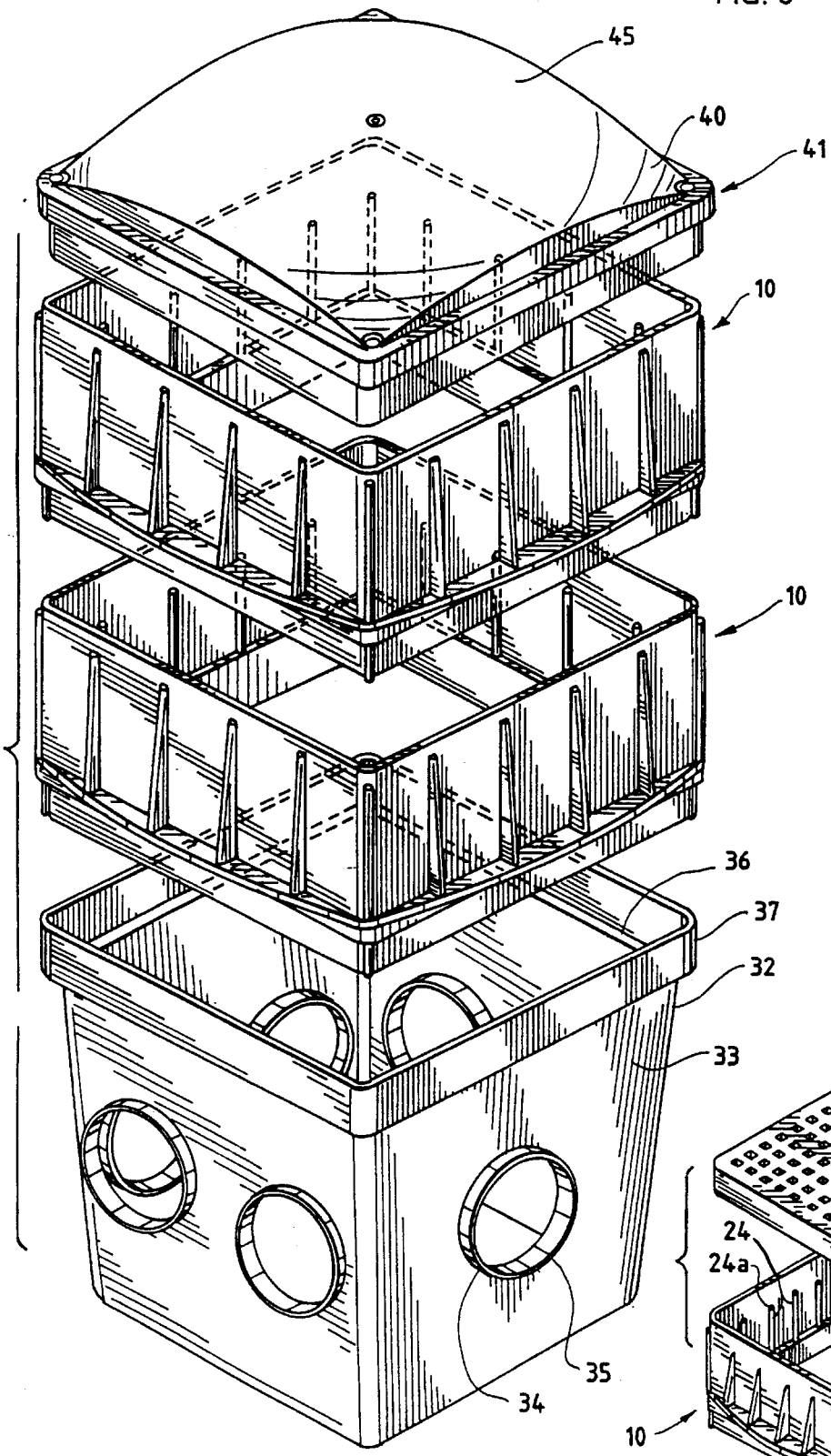
FIG. 6 is a fragmentary perspective view of a plurality of stackable risers in combination with an imperforate cover and a distribution box.
Figure 8:
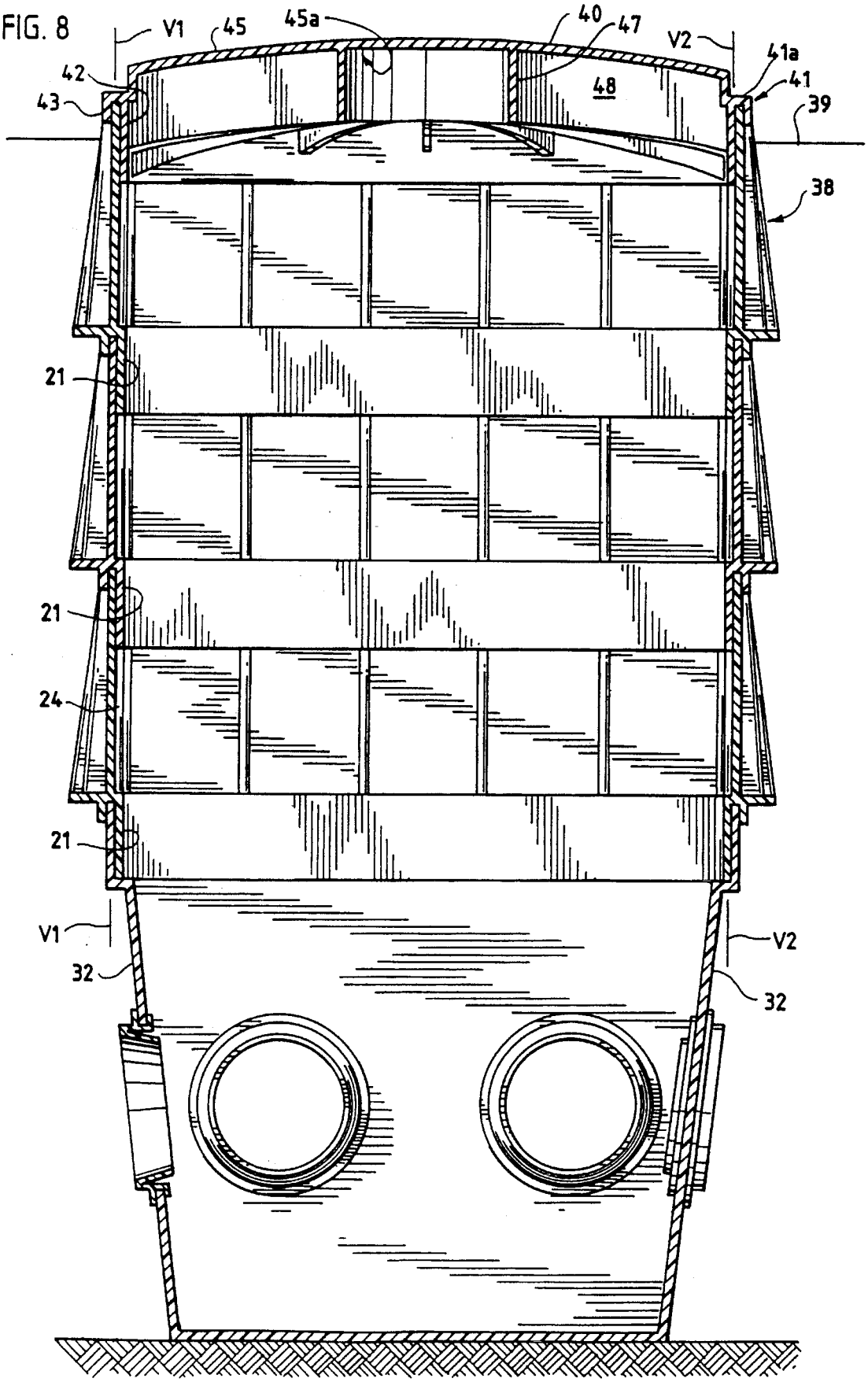
FIG. 8 is a cross-sectional view illustrating a plurality of stackable risers of this invention in combination with an imperforate cover and distribution box.

FIGS. 6 and 8 illustrate the combination of a plurality of risers and the stacked risers in combination with a distribution box 32. In this specification the term distribution box is used to also cover drop boxes which are a specific subclass of the more generic term "distribution box". A particularly advantageous drop box is disclosed in co-owned U.S. Pat. No. 4,663,036, which is hereby incorporated by reference. Distribution box 32 includes angled side walls 33 which define apertures 34 for receiving sealing members 35 and lengths of pipe (not shown). A peripheral transverse shoulder 36 extends from the top of side walls 33 and generally extends in a horizontal or transverse direction. An upright or vertically-extending flange 37 extends from shoulder 36 and is shaped to be received within the channel 23 of connecting member 18 of riser 10.

FIG. 6 illustrates two risers 10 positioned for connection to distribution box 32, and FIG. 8 illustrates three stackable risers 10 which form a vertical riser stack or tower 38 between grade level 39 and the underground component, distribution box 32. As most clearly illustrated in FIG. 8, when risers 10 are fitted together, side walls 11 of risers 10 are aligned along a common vertical axis V1. Similarly, the inner or first dependent legs 21 of each of the connecting members 18 and the inner ribs 24, as well as the inner shoulder of intermediate member 20, are also aligned along a common second vertical axis V2. When positioned underground, shoulder 36 of distribution box 32 rests upon the backfill and, hence, any weight-bearing loads applied to the top of the vertical tower 38 of risers 10 will be transmitted directly through the vertical axes V1 and V2 to shoulder 36 and the backfill. Thus, any such weight-bearing loads are not significantly applied to the angled side wall 33 of distribution box which might otherwise cause breakage.

Figure 10:
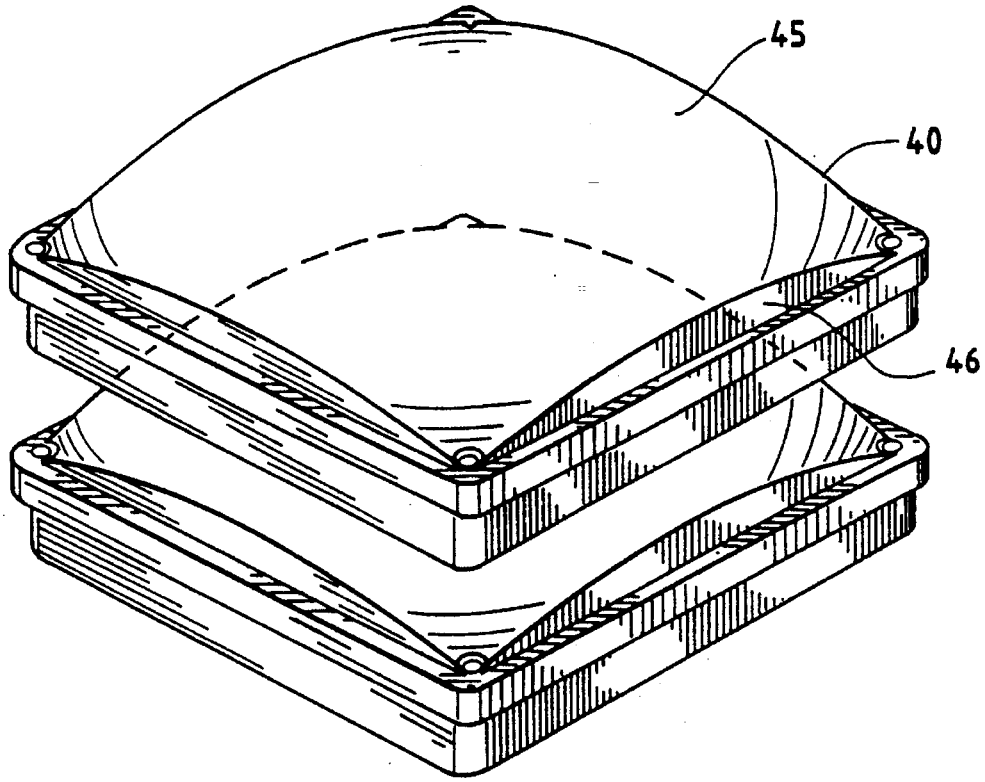
FIG. 10 is a perspective view illustrating a plurality of imperforate covers of this invention.
Figure 11:
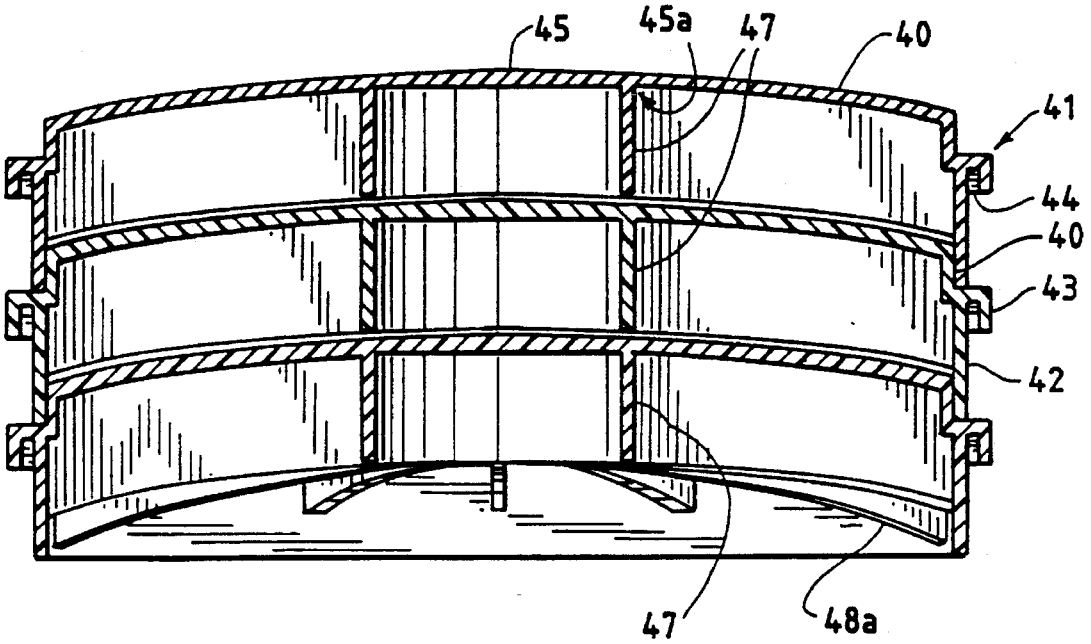
FIG. 11 is a side cross-sectional view of a plurality of imperforate covers of this invention.

Cover means are provided for attaching to and sealing the open end 17 defined by the free edge portion 15 of the uppermost riser in the vertical stack 38. The cover means may advantageously take the form of an imperforate cover 40 which is illustrated in FIGS. 2, 6, and 8–11. As most clearly seen in FIGS. 8 and 11, cover 40 includes a peripheral attaching portion 41 which includes an intermediate transverse portion 41*a*, and first and second depending legs 42 and 43. Attachment portion 41 defines a channel 44 between depending legs 42 and 43 which is shaped to receive the free end portion 15 of side wall 11 of riser 10. Most advantageously, attaching portion 41 may have the same, or a similar, construction as the connecting member 18 of riser 10. Cover 40 further includes a dome-shaped plate portion 45 which connects to the intermediate portion 41*a*. The dome-shaped plate portion 45 preferably includes stacking surfaces 46 which extend generally vertically upward from the intermediate portion 41*a* of attachment portion 41 and which are shaped to be received within the depending leg 42 of the attachment portion 41 of another imperforate cover 40. This enables a plurality of such covers to be easily stackable for storage or transport as illustrated in FIGS. 10 and 11.

cover 40 preferably includes a circular rib 47 which extends generally downward from an inner central portion 45*a* of plate portion 45. A plurality of radially-spaced, downwardly-extending reinforcing ribs 48 are provided which extend between circular rib 47 and depending leg 42 of cover 40. This particular arrangement of a central circular rib 40 and radially-spaced ribs 48 is particularly advantageous for providing a weight-bearing cover for the risers of this invention and for distributing weight-bearing loads along the first and second vertical axes V1 and V2. Preferably, radially-spaced ribs 48 include curved surfaces 48*a* which are shaped to conform to the dome-shaped plate portion 45 of an adjacent cover 40 when the lids are stacked together as illustrated in FIG. 11.

Figure 7:
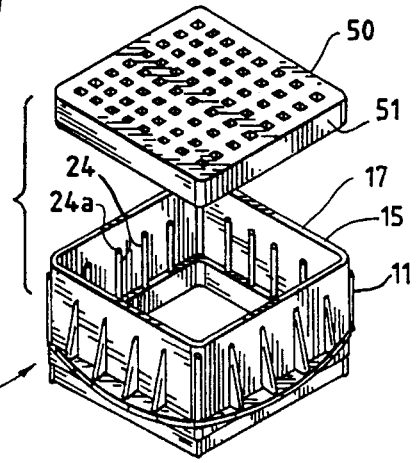
FIG. 7 is a perspective view of the stackable riser of this invention and a drain grate.

In an alternate construction, the cover means may take the form of a drain grate 50 as illustrated in FIG. 7. Drain grate 50 includes a peripheral side wall 51 which is shaped to be received within the first end opening 17, which is defined by the upper edge portion 15 of side wall 11, of riser 10. When assembled together, peripheral side wall 51 preferably rests upon shoulders 24*a* of inner ribs 24. While it be understood that any drain grate can be used with the riser of this invention, a particularly advantageous drain grate is commercially available from the assignee of the present invention, namely Tuf-Tite, Inc. of Wauconda, Ill., under its part number B4-DG, for example. Such drain grates may be used with the riser of this invention in particular applications such as forming sump drains, field drains, or the like.

Figure 9:
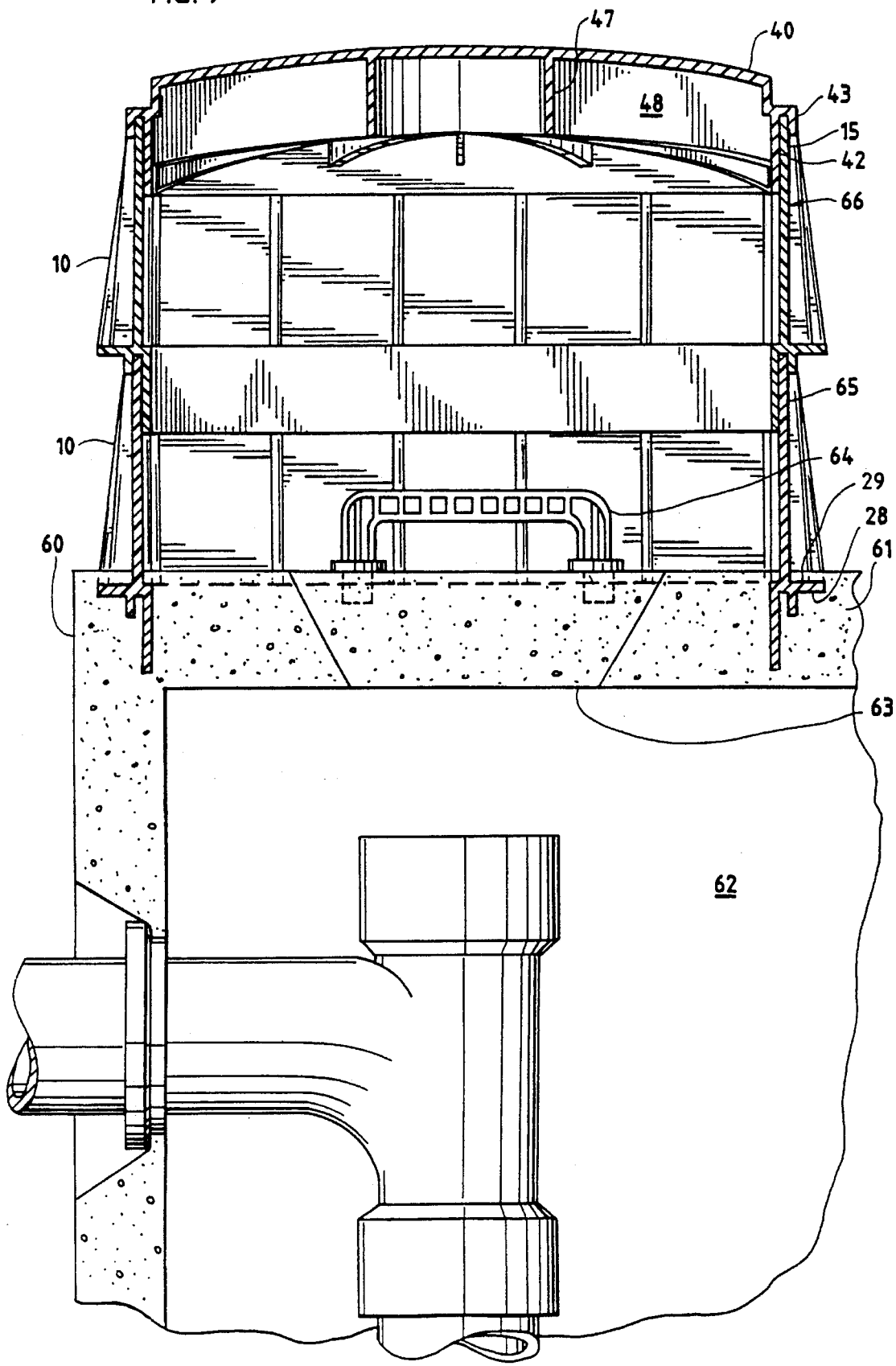
FIG. 9 is a cross-sectional view of a plurality of stackable risers of this invention in combination with an imperforate cover and a septic tank.

The combination of a plurality of stackable risers 10 of this invention and a septic tank 60 is illustrated in FIG. 9. Septic tank 60 includes a concrete or cement top 61 having an access means for allowing access to the interior 62 of septic tank 60. In the illustration given in FIG. 9, the access means takes the form of a concrete lid 63 which is connected to a plastic handle 64. A particularly advantageous plastic handle for embedding in concrete components is commercially available from the assignee of the present invention, namely Tuf-Tite, Inc. of Wauconda, Ill., under its part number H1, for example.

A vertical column of risers 10 includes a first riser 65, and securement means are provided for attaching first riser 65 over the access means of septic tank 60. In the illustration given in FIG. 9, the securement means take the form of the concrete or cement top 61 of the septic tank in which the connecting member 18 of riser 65 is embedded. Most advantageously, the horizontal rib 28 of riser 65 is also embedded in the concrete of septic tank top 61 so that the concrete acts on ledge 29 to firmly secure the riser 65 to the septic tank. The vertical stack of risers also includes an uppermost riser, which in some constructions may also be the first riser, but is illustrated in FIG. 9 as riser 66. Riser 66 is connected to riser 65 as previously discussed and also includes an imperforate cover 40 as also previously discussed.

Figure 2:
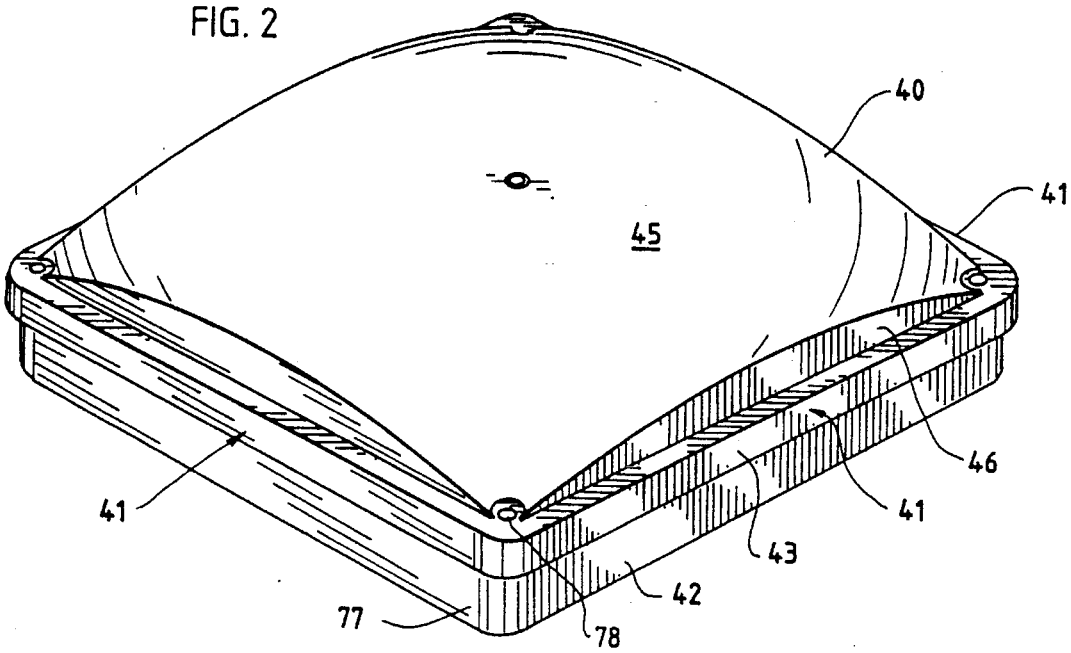
FIG. 2 is a perspective view of an imperforate cover which is attachable to the stackable riser of this invention.
Figure 3:
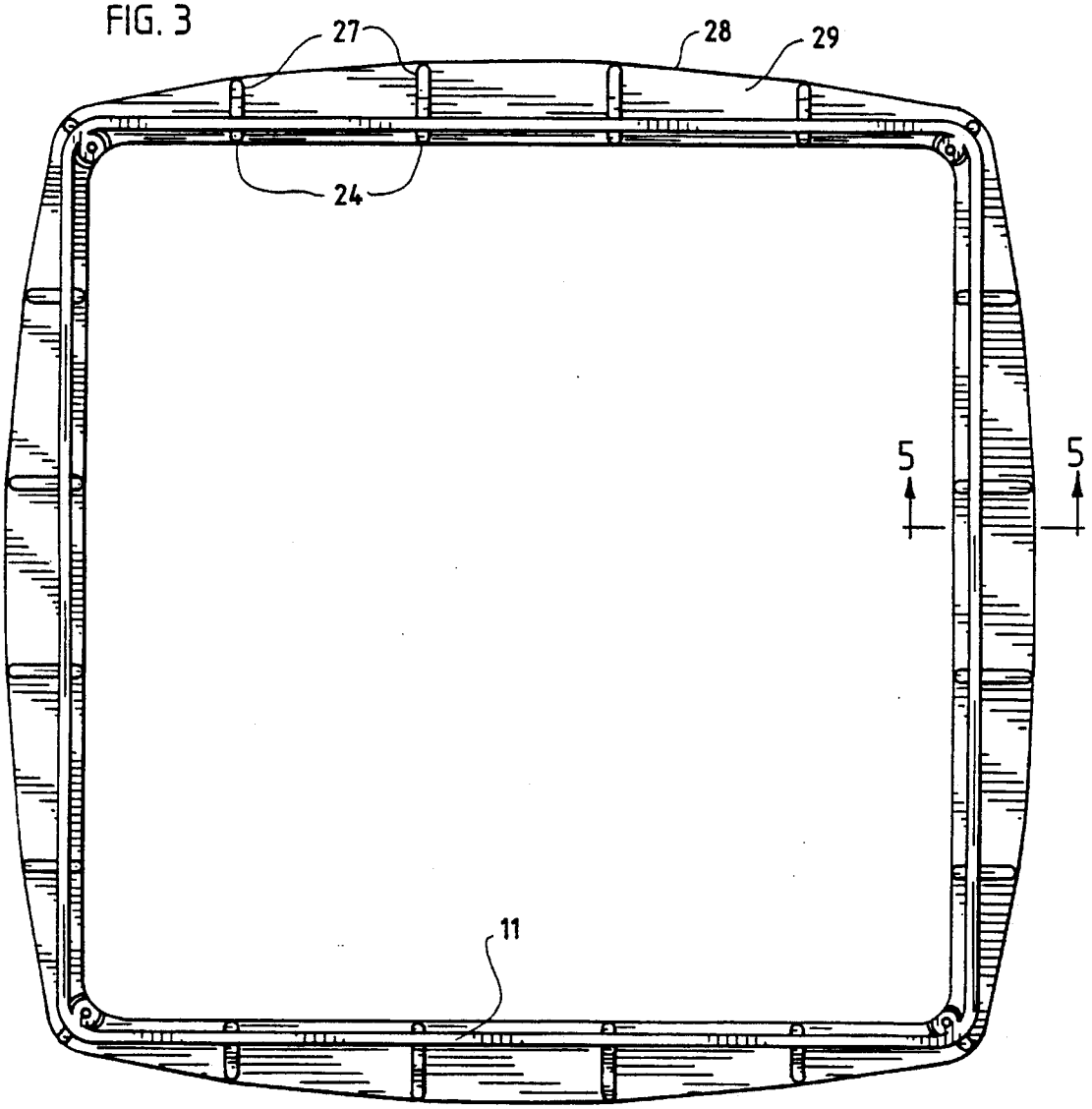
FIG. 3 is a top plan view of the stackable riser of this invention.

Referring to FIG. 1, side wall 11 defines a plurality of corners 70, 71, 72, and 73 although the side wall may define a different number of corners depending upon the particular peripheral shape of the riser. Each of the corners 70–73 is provided on inner surface 12 with a vertically-extending, generally tubular attachment portion 74 which includes a shoulder 75 and an aperture 76 which is shaped to receive a fastener member, such as a screw. Referring to FIG. 2, cover 40 is preferably provided with longitudinally extending attachment members 77 (shown in dash lines) which defines an aperture 78 which is shaped to receive a screw. Accordingly, a plurality of screws can be passed through apertures 78 and into apertures 76 to secure cover 40 to the uppermost riser.

Each of the corners of the riser may also be provided with a plurality of locking lugs 80 disposed on inner dependent leg 21 as shown in FIG. 1. When a plurality of risers are stacked together, locking lugs 80 interact with the adjacent riser to create a tight frictional seal between the adjacent risers.

While in the foregoing embodiments of the invention have been disclosed in considerable detail for purposes of illustration, it will be understood by those skilled in the art that many of these details may be varied without departing from the spirit and scope of the invention.

I claim:

1. A stackable riser comprising:

a continuous peripheral side wall having outer and inner surfaces and having a first free edge portion which defines a first end opening and having a second edge portion, said side wall extending in a substantially perpendicular direction with respect to a horizontal plane;

a general inverted U-shaped connecting member extending from said second edge portion of said side wall and defining an oppositely-facing second end opening, said U-shaped connecting member including a transverse intermediate portion and first and second generally perpendicular dependent legs which define a channel between said dependent legs which is shaped to receive a first free edge portion of another riser; and a plurality of vertically-extending inner ribs positioned on said inner surface of said side wall, said inner ribs positioned on said inner surface of said side wall, said inner ribs including terminal edges which form shoulders positioned a predetermined distance away from a tip of said first free edge portion of said side wall.

2. The invention of claim 1 in which said first dependent leg of said U-shaped connecting member has a smaller perimeter than said peripheral side wall and has a vertical height which is approximately equal to said predetermined distance between said shoulders of said inner ribs and said tip of said first free edge portion.

3. The invention of claim 2 in which said transverse intermediate portion of said U-shaped connecting member forms inner and outer shoulders and said vertically-extending inner ribs include opposite ends positioned on said inner shoulder.

4. The invention of claim 1 in which a plurality of vertically-extending outer ribs are disposed on said outer surface of said side wall.

5. The invention of claim 1 in which a horizontally-extending rib is connected to said side wall.

6. The invention of claim 5 in which said horizontally-extending rib extends transversely outward from said transverse intermediate portion of said U-shaped connecting member.

7. The invention of claim 5 or 6 in which said horizontally-extending rib includes a ledge.

8. A stackable riser comprising:

a continuous peripheral side wall having outer and inner surfaces, said peripheral side wall including four sidewall sections and having a first free edge portion which defines a first end opening and having a second edge portion, said side wall extending in a substantially perpendicular direction with respect to a horizontal plane, and said inner surface of said side wall including four corners, each of said corners being provided with a vertically-extending attachment member which includes a terminal edge which forms a shoulder positioned a predetermined distance away from a tip of said first free edge portion of said side wall, each of said terminal edges of said attachment members being provided with an aperture shaped to receive a fastener; and a U-shaped connecting member extending from said second edge portion of said side wall and defining an oppositely-facing second end opening, said U-shaped connecting member including a transverse intermediate portion and first and second generally perpendicular dependent legs which define a channel between said dependent legs which is shaped to receive a first free edge portion of another riser.

9. The invention of claim 1 in which said side wall and said U-shaped connecting member include four corners, each of said four corners including a vertically-extending locking leg disposed on said first dependent leg.

10. The invention of claim 8 in which each of said side wall sections has a length of approximately 8 to 22 inches.

11. The invention of claim 8 in which each of said side wall sections has a length of approximately 16 inches.

12. A stackable riser combination comprising:

a plurality of stackable risers which are interlocked together to form a vertical passageway, each of said risers comprising:

a continuous peripheral side wall having outer and inner surfaces and having first and second edge portions, said inner surface of said side wall defining a passageway extending between said first and second edge portions; and a U-shaped connecting member extending from said second edge portion of said side wall and including a transverse intermediate portion and first and second generally perpendicular dependent legs which define a channel between said dependent legs which is shaped to receive a first edge portion of another riser;

said plurality of stackable risers including at least first and second risers in which said first edge portion of said first riser is inserted into said U-shaped connecting member of said second riser, said risers further including a plurality of vertically-extending inner ribs positioned on said inner surface of said side wall, said inner ribs including terminal edges which form shoulders positioned a predetermined distance away from a tip of said first edge portion, said first dependent leg of said U-shaped connecting member of said second riser being positioned on said shoulders of said inner ribs of said first riser.

13. The invention of claim 12 in which said transverse intermediate portions of said U-shaped connecting members of each of said risers forms inner and outer shoulders and said vertically-extending inner ribs include opposite edges positioned on said inner shoulders.

14. The invention of claim 12 which a plurality of vertically-extending outer ribs are disposed on said outer surfaces of said side walls of each of said plurality of risers.

15. The invention of claim 12 in which a horizontally-extending rib extends transversely outward from said side walls of each of said risers.

16. The invention of claim 15 in which said horizontally-extending rib extends transversely outward from said transverse intermediate portion of said U-shaped connecting member of each of said risers.

17. The invention of claim 15 or 16 in which each of said horizontally-extending ribs includes a ledge.

18. The invention of claim 12 in which said peripheral side wall of each of said risers includes four sidewall sections and said inner surface of said side wall includes inner four corners, each of said corners being provided with a vertically-extending attachment member which includes a terminal edge which forms a shoulder positioned a predetermined distance away from a tip of said first edge portion of said side wall, each of said terminal edges of said members being provided with an aperture shaped to receive a screw.

19. The invention of claim 12 in which said side wall and said U-shaped connecting member of each of said riser includes four corners, each of said corners including a vertically-extending locking leg disposed on said first dependent leg.

20. The invention of claim 18 in which each of said side wall sections has a length of approximately 8 to 22 inches.

21. The invention of claim 18 in which each of said side wall sections has a length of approximately 16 inches.

22. The invention of claim 12 which said peripheral side walls of each of said plurality of said risers are aligned along a first common vertical axis.

23. The invention of claim 12 in which said inner ribs and said first dependent leg of each of said plurality of said risers which are aligned along a second common vertical axis.

24. A stackable riser and underground component combination comprising:

an underground component positioned below grade level and including access means for allowing access to an interior of said underground component;

at least one stackable riser including an uppermost riser and a continuous peripheral side wall having inner and outer surfaces and having a top edge portion and a bottom edge portion, said inner surface of said peripheral wall defining a vertical passageway extending between said top and bottom edge portions;

said at least one stackable riser further including a U-shaped connecting member extending from said bottom edge portion of said side wall which includes a transverse intermediate portion and first and second generally perpendicular dependent legs, said U-shaped connecting member defining a channel between said dependent legs which is shaped to receive a top edge portion of another riser;

said at least one stackable riser including a first riser which has its U-shaped connecting member positioned on said underground component so that said passageway is positioned above said access means;

cover means for attaching to said uppermost riser and for covering said vertical passageway, said cover means comprising an imperforate cover including a generally U-shaped peripheral attachment portion which includes a transverse intermediate portion and first and second depending legs, said U-shaped attachment portion defining a channel between said first and second depending legs which is shaped to receive said top edge portion of said uppermost riser; and a plurality of vertically-extending inner ribs positioned on said inner surface of said side wall of said at least one stackable riser, said inner ribs including terminal edges which form shoulders positioned a predetermined distance away from a tip of said top edge portion of said side wall.

25. The invention of claim 24 in which said first depending leg of said cover has a smaller perimeter than said side wall and said second depending leg has a greater perimeter than said side wall, said first depending leg having a vertical height approximately equal to said predetermined distance between said shoulders of said inner ribs on said riser and said tip of said top edge portion of said riser.

26. The invention of claim 24 in which said imperforate cover includes a dome-shaped plate portion connected to said transverse intermediate portion of said U-shaped peripheral attachment portion of said cover, and a circular rib member positioned on an inside surface of said dome-shaped plate portion and extending transversely downward from a central portion thereof; said cover further including a plurality of radially-spaced ribs extending between said circular portion and said first depending leg of said U-shaped attachment portion.

27. The invention of claim 26 in which said imperforate cover includes a plurality of corners formed by said first depending leg of said attachment portion, each of said corners being provided with a vertically-extending member shaped to receive a screw.

28. The invention of claim 24 in which said imperforate cover includes a dome-shaped plate portion connected to said transverse intermediate portion of said U-shaped peripheral attachment portion of said cover, and generally vertically-extending stacking surfaces which extend between said transverse portion of said U-shaped attachment portion and said dome-shaped plate portion, said stacking surfaces being receivable within a peripheral shape of said first depending leg of said U-shaped attachment portion of another imperforate cover.

29. The invention of claim 24 in which said underground component comprises a distribution box having angled side walls, a peripheral transverse shoulder at a top of said angled side walls, and a peripheral vertically-extending flange extending from said transverse shoulder; said flange being shaped to be receivable by said channel of said U-shaped connecting member of said risers.

30. The invention of claim 29 in which said flange of said distribution box is inserted in said U-shaped connecting member of said first riser and said side wall of said at least one riser is aligned along a common vertical axis which passes through said flange of said distribution box.

31. The invention of claim 30 in which said transverse of said distribution box is positioned over backfill.

* * * * *